US005185231A

United States Patent [19]

Weigel

[11] Patent Number: 5,185,231

[45] Date of Patent: Feb. 9, 1993

[54] DRY SILVER SYSTEMS WITH FLUORAN LEUCO DYES

[75] Inventor: David C. Weigel, White Bear Lake, Minn.

[73] Assignee: Minnesota Mining and Manufacturing Company, Saint Paul, Minn.

[21] Appl. No.: 749,573

[22] Filed: Aug. 26, 1991

[51] Int. Cl.[5] ..... G03C 5/54; G03C 7/26

[52] U.S. Cl. ..... 430/203; 430/201; 430/224; 430/402; 430/542; 430/565

[58] Field of Search ..... 430/201, 203, 224, 542, 430/402, 565

[56] References Cited

U.S. PATENT DOCUMENTS

| | | | |
|---|---|---|---|
| 3,457,075 | 7/1969 | Morgan et al. | 96/67 |
| 3,531,286 | 9/1970 | Renfrew | 430/351 |
| 3,655,382 | 4/1972 | Brault et al. | 96/48 |
| 3,671,244 | 6/1972 | Bissonette et al. | 96/54 |
| 3,676,135 | 7/1972 | Musliner | 96/54 |
| 3,839,049 | 10/1974 | Simons | 96/114.6 |
| 3,985,565 | 10/1976 | Gabrielsen et al. | 430/203 |
| 4,021,240 | 5/1977 | Cerquone et al. | 430/203 |
| 4,022,617 | 5/1977 | McGuckin | 430/203 |
| 4,042,392 | 8/1977 | Gysling et al. | 96/48 |
| 4,187,108 | 2/1980 | Willis | 430/203 |
| 4,260,677 | 4/1981 | Winslow et al. | 430/618 |
| 4,374,921 | 2/1983 | Frenchik | 430/338 |
| 4,430,415 | 2/1984 | Aono et al. | 430/203 |
| 4,455,363 | 6/1984 | Naito et al. | 430/203 |
| 4,460,681 | 7/1984 | Frenchik | 430/502 |
| 4,463,079 | 7/1984 | Naito et al. | 430/203 |
| 4,499,172 | 2/1985 | Hirai et al. | 430/203 |
| 4,499,180 | 2/1985 | Hirai et al. | 430/559 |
| 4,503,137 | 3/1985 | Sawada | 430/203 |
| 4,594,307 | 6/1986 | Ishida | 430/201 |
| 5,051,333 | 9/1991 | Yanagihara et al. | 430/224 |

FOREIGN PATENT DOCUMENTS 59-5239 1/1984 Japan ..... 1/40

*Primary Examiner*—Richard L. Schilling

*Attorney, Agent, or Firm*—Gary L. Griswold; Walter N. Kirn; Gregory A. Evearitt

[57] ABSTRACT

Certain fluoran dyes have been found to be effective reducing agents for silver ion in dry silver constructions. The fluoran dyes have the following structure:

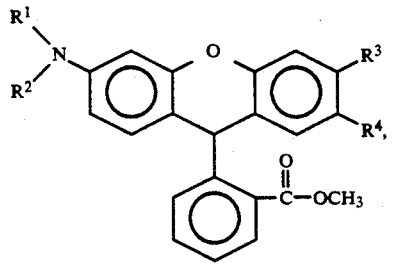

wherein:

$R^1$ represents methyl or n-butyl;

$R^2$ represents n-butyl or cyclohexyl;

$R^3$ represents hydrogen, methyl, or methoxy; and $R^4$ represents

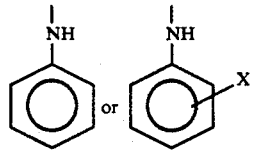

where X represents halogen (preferably chlorine); and a binder.

23 Claims, No Drawings

DRY SILVER SYSTEMS WITH FLUORAN LEUCO DYES

FIELD OF THE INVENTION

The present invention relates to a dry silver system for providing a negative image. This invention also relates to a photothermographic imaging system of the dry silver type for providing a negative image by dye diffusion-transfer.

BACKGROUND OF THE INVENTION

Silver halide photothermographic imaging materials, often referred to as "dry silver" compositions because no liquid development is necessary to produce the final image, have been known in the art for many years. These imaging materials basically comprise a light insensitive, reducible silver source; a light sensitive material which generates silver when irradiated; and a reducing agent for silver ions. The light sensitive material is generally photographic silver halide which must be in catalytic proximity to the light insensitive silver source. Catalytic proximity is an intimate physical association of these two materials so that when silver specks or nuclei are generated by the irradiation or light exposure of the photographic silver halide, those nuclei are able to catalyze the reduction of the silver source by the reducing agent. It has been long understood that silver is a catalyst for the reduction of silver ions and the silver-generating light sensitive silver halide catalyst progenitor may be placed into catalytic proximity with the silver source in a number of different fashions, such as partial metathesis of the silver source with a halogen-containing source (e.g., U.S. Pat. No. 3,457,075), coprecipitation of the silver halide and silver source material (e.g., U.S. Pat. No. 3,839,049), and any other method which intimately associates the silver halide and the silver source.

The silver source used in this area of technology is a material which contains silver ions. The earliest and still preferred source comprises silver salts of long chain carboxylic acids, usually of from 10 to 30 carbon atoms. The silver salt of behenic acid or mixtures of acids of like molecular weight have been primarily used. Salts of other organic acids or other organic materials such as silver imidazolates have been proposed, and U.S. Pat. No. 4,260,677 discloses the use of complexes of inorganic or organic silver salts as image source materials.

In both photographic and photothermographic emulsions, exposure of the silver halide to light produces small clusters of silver atoms. The imagewise distribution of these clusters is known in the art as a latent image. This latent image generally is not visible by ordinary means and the light sensitive article must be further processed in order to produce a visual image. The visual image is produced by the catalytic reduction of silver ions which are in catalytic proximity to the specks of the latent image.

As the visible image is produced entirely by silver, one can not readily decrease the amount of silver in the emulsion without reducing the available maximum image density. Reduction of the amount of silver is desirable in order to reduce the cost of raw materials used in the emulsion.

One traditional way of attempting to increase the image density of photographic and photothermographic emulsions without increasing or while decreasing the amount of silver in the emulsion layer is by the addition of dye forming materials in the emulsion. In this way a dye enhanced silver image can be produced, as for example in U.S. Pat. Nos. 3,531,286, 4,187,108, 4,426,441, 4,374,921 and 4,460,681.

It has been described in the patent literature to transfer a dye image formed in a photothermographic system by means of a transfer solvent as is disclosed, for example, in U.S. Pat. Nos. 3,985,565, 4,021,240, 4,022,617, 4,430,415, 4,463,079, 4,455,363, 4,499,172, 4,499,180, and 4,503,137.

Japanese Kokai No. 59-5239 discloses a photothermographic contact diffusion system wherein a chemical reaction occurs in an image receiving layer between a diffused leuco dye and an acidic color developing agent.

U.S. Pat. Nos. 3,655,382; 3,676,135; 3,671,244; and 4,042,392 disclose the use of formazan dyes in a conventional (wet) silver halide, non-thermographic construction.

SUMMARY OF THE INVENTION

In accordance with the present invention, it has been found that certain fluoran dyes can act as effective reducing agents for silver ion in dry silver constructions. In the process, the fluoran dyes are oxidized to their black colored form. The oxidized fluoran dyes not only form black images with the silver present, but also form black images when diffused to a receptor layer and the silver is removed.

Thus, in one embodiment the present invention provides a heat-developable photographic material containing negative image forming system comprising: (a) a light insensitive silver source material; (b) a light sensitive silver halide; (c) a fluoran dye of the formula:

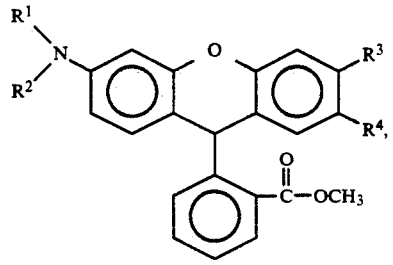

wherein:

$R^1$ represents methyl or n-butyl;

$R^2$ represents n-butyl or cyclohexyl;

$R^3$ represents hydrogen, methyl, or methoxy; and $R^4$ represents

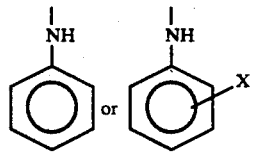

where X represents halogen (preferably chlorine); and (d) a binder.

In another embodiment, the present invention provides a photothermographic composite structure comprising:

a) an image-receiving element comprising a polymeric image-receiving layer having a glass transition temperature in the range of 20° to 200° C.; and b) strippably adhered to the image-receiving element, an imageable photothermographic element comprising in at least one layer thereof a binder, a silver source material, photosensitive silver halide in catalytic proximity to the silver source material, and a fluoran dye of the construction disclosed earlier herein.

The foregoing disclosed dry silver system is particularly advantageous because the use of the particular fluoran dyes disclosed herein earlier allows for the production of a dye image that is more stable than just the regular dry silver type image. Additionally, the inventive dry silver system allows for the use of less silver as compared to conventional dry silver systems.

The present invention also makes possible a silver-free colored dye image reproduction by a dye thermal diffusion-transfer process without use of chemicals, solvents, or post-treatments to aid in the transfer process. A photothermographic reaction in a heat-developable, photosensitive layer(s) containing a fluoran dye, an organic silver salt, a photocatalyst and preferably developer modifier(s), yields the reduction of silver to create a silver image in the irradiated portions of the photothermographic element. The fluoran dye undergoes oxidation to its colored (black) form in the same irradiated portion of the photothermographic element. The remaining fluoran dye can be diffusion-transferred into a dyeable, polymeric, image-receiving layer which is coated or placed in intimate contact adjacent to the heat developable photosensitive layer(s) yielding a positive dye image in the non-irradiated portion of the photothermographic element. Only heat is required in the transfer process.

The heat-developable, photosensitive layer(s) of the invention can be strippably adhered to the image-receiving layer on the same substrate to form a single composite structure, or, in another embodiment, the heat-developable, photosensitive layer(s) is separately coated on a different (or second) substrate from that of the image-receiving element. In the latter embodiment, the image-receiving layer of the image-receiving element and the exposed photosensitive layer of the photothermographic element are placed in intimate contact with each other (i.e., pressed together in a two-sheet assemblage) before development of the image. Subsequently, the imaged photothermographic element is stripped away from the receiving layer with its dye image.

In the present invention each of the elements (the photothermographic and image-receiving) may, independently and optionally, be adhered to a support. Preferably, the support comprised a polymeric resin which is chosen to require no adhesive for the element to adhere to a support, although an adhesive may be used.

In every case, it is required that the latent image-bearing and the image-receiving layers be in intimate face-to-face contact with each other during development of the image. Exposure can be through either the image-receiving element or the photothermographic element. For this to be possible, at least one of the elements and its support, when present, must be transparent.

After imagewise exposure and subsequent heat development and simultaneous thermal diffusion-transfer of the dye into the image-receiving layer, the photosensitive layer(s) which contain a reduced silver image is dry-stripped away from the image-receiving layer to provide a pure and clear dye image not contaminated with the reduced metallic silver image on the image-receiving layer.

No special solvents are used in the diffusion-transfer process and the present invention method requires no color coupler or other chemicals in the image receiving layer to provide the dye image.

DETAILED DESCRIPTION

In one embodiment, the present invention provides a heat-developable material containing a negative image-forming system comprising: (a) a light insensitive silver source; (b) a light sensitive silver halide; (c) a fluoran dye of the formula:

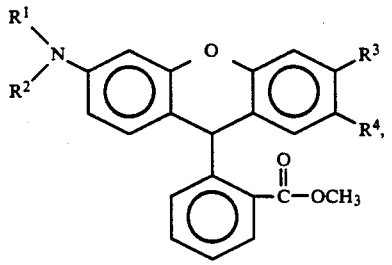

wherein:

$R^1$ represents methyl or n-butyl;

$R^2$ represents n-butyl or cyclohexyl;

$R^3$ represents hydrogen, methyl, or methoxy; and $R^4$ represents

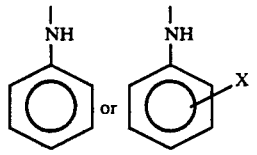

where X represents halogen (preferably chlorine); and (d) a binder.

The light insensitive silver source material ordinarily may be any material which contains a reducible source of silver ions. Silver salts of organic acids, particularly long chain (10 to 30, preferably 15 to 28 carbon atoms) fatty carboxylic acids are preferred in the practice of the present invention. The silver source material should constitute from about 20 to 70 percent by weight of the image forming system. Preferably, it is present as 30 to 55 percent by weight.

The silver halide may be any photosensitive silver halide such as silver bromide, silver iodide, silver chloride, silver bromoiodide, silver chlorobromoiodide, silver chlorobromide, etc., and may be added to the article in any fashion which places it in catalytic proximity of the silver source. The silver halide is generally present as 0.75 to 15 percent by weight of the image forming system, although larger amounts are useful. It is preferred to use from 1 to 10 percent by weight silver halide in the image forming system and most preferred to use from 1.5 to 7.0 percent.

The silver halide may be provided by in situ halidization or by the use of preformed silver halide. The use of sensitizing dyes for the silver halide is particularly desirable. These dyes can be used to match the spectral response of the emulsions to the spectral emissions of intensifier screens. It is particularly useful to use J-banding dyes to sensitize the emulsion as disclosed in U.S. Pat. No. 4,476,220.

The fluoran dyes used in the present invention have the structure as disclosed earlier herein. Such fluoran dyes are commercially available and can be made according to procedures of organic chemistry well-known to those skilled in the art. The fluoran dyes serve as a reducing agent for the light insensitive silver source and therefore, are oxidized in the process to their colored (black) form. The fluoran dye is generally present as 0.50 to 2.0 percent by weight of the image forming system. It is preferred to use from 0.75% to 1.0% weight fluoran dye in the image forming system and most preferred to use from 0.8% to 0.9% weight percent.

In addition to the fluoran dyes, auxiliary reducing agents for silver ion may also be used such as phenidone, hydroquinones, catechol, and hindered phenol reducing agents.

The binder may be selected from any of the well-known natural and synthetic resins such as gelatin, polyvinyl acetals, polyvinyl chloride, cellulose acetate, polyolefins, polyesters, polystyrene, polyacrylonitrile, polycarbonates, and the like. Copolymers and terpolymers are, of course, included in these definitions. The polyvinyl acetals, such as polyvinyl butyral and polyvinyl formal, and vinyl copolymers, such as polyvinyl acetate/chloride are particularly desirable. The binders are generally used in a range of from 20- to 75 percent of the image forming system.

Toners such as phthalazinone, 1,2,3-benzotriazin-4(3H)-one, phthalazine and phthalic acid are not essential to the construction, but are highly desirable. These materials may be present, for example, in amounts of from 0.2 to 5 percent by weight of the image forming system.

The present invention also provides a photothermographic composite structure comprising: (a) a dyeable image-receiving element comprising a polymeric image-receiving layer having a glass transition temperature in the range of 20° to 200° C., which image-receiving layer is optionally adhered to at least one surface of a support; and (b) strippably adhered to the polymeric image-receiving layer, an imageable photothermographic element comprising, in at least one imageable layer thereof a binder, a light-insensitive silver source material, photo-sensitive silver halide in catalytic proximity to the light-insensitive silver source material, and a fluoran dye of the type disclosed earlier herein.

In the present invention, "strippably adhered" means, as is well understood in the art, that the layers are sufficiently well adhered to each other to survive mild handling without the layers separating and yet still be separable from each other by hand when required without tearing of individual layers. This generally means that a peel force (delaminating resistance) of about 1 to 50 g/cm width (0.1 to 4.5 ounces per inch width) of layer is needed to separate the two layers when one layer is pulled at 180° from the other at about 127 mm (5 inches) per minute. Preferably this peel force is in the range of 1 to 20 g/cm width (0.1 to 1.8 ounces per inch width).

When the heat-developable, imageable, photo-thermographic construction of the invention is imagewise exposed to actinic radiation (i.e., infrared, visible, ultraviolet, x-ray, and electron beam) and then heat-developed, an oxidation-reduction reaction occurs between the organic silver salt and the fluoran dye by means of an exposed light sensitive silver halide as a catalyst. Accordingly, a reduced silver image and an oxidation of the fluoran dye to its colored black form are simultaneously formed in the light-exposed area of the material. The fluoran dye image can be thermally diffusion-transferred to an image-receiving layer. The thermal development of the fluoran dye and the thermal diffusion-transfer of the fluoran dye to the image-receiving layer occurs simultaneously without use of any post-treatment, chemicals, or transfer solvents.

After the heat-development, the heat-developable photosensitive element containing the reduced negative metallic silver image and other chemical reactants can be peeled apart from the dye-bearing image-receiving layer. A pure and stable negative dye image is obtained on the image-receiving layer.

The imageable photothermographic element of the present invention can be a unitary layer or it can comprise two or more layers as is well known in the art.

The optional support bases or substrates of the photothermographic imageable element of the invention as well as of the image-receiving element can be any supporting materials such as paper, polymeric (plastic) film, glass, or metal. At least one of the imageable and image-receiving elements must be flexible and at least one must be transparent to allow for imaging and stripping functions. Transparent or opaque polymeric films are particularly useful. Preferably, the support comprises a thermoplastic resin which is useful as the polymeric image-receiving layer, e.g., polyesters such as polyethylene or poly(ethylene terephthalate); cellulosics such as cellulose acetate, cellulose butyrate, cellulose acetate butyrate, cellulose propionate, cellulose acetate propionate; polyolefins such as polystyrene; polyvinyl resins such as polyvinylchloride and polyvinylacetate; copolymeric vinyl resins such as copolymer of vinylchloride-vinylacetate, copolymer of vinylidene chloride-acrylonitrile, and copolymer of styrene-acrylonitrile. This eliminates an additional preparation (or coating) of the image-receiving layer. Combinations of resins (binders) are also useful.

The fluoran dye, which can be present in the photosensitive layer or in an adjacent layer, is typically heated to a temperature in the range of 80° to 250° C. (176° to 482° F.) for a time period of 0.5 to 300 seconds in order to diffuse the dye into the thermoplastic resin-containing receiving layer of the invention.

The light insensitive silver source material, silver halide, fluoran dye, and optional auxiliary reducing agent for silver ion, and binder used in the construction are as disclosed herein earlier.

The photothermographic element can include coating additives to improve the strippability of the imaged layer, e.g., fluoraliphatic polyesters dissolved in ethyl acetate (Fluorad TM FC 431, 3M, St. Paul, Minn.) can be added in an amount in the range of 0.02 to 0.5 weight percent of the imageable layer, preferably 0.1 to 0.3 weight percent. Alternatively, a coating additive to enhance strippability can be added to the image-receiving layer in the same weight range. No solvents are used in the stripping process. The strippable layer has a delaminating resistance of 1 to 50 g/cm and a layer strength greater than, and preferably at least two times greater than, its delaminating resistance.

Selection of the polymeric resin and solvent used in coating the photosensitive layer is a significant factor in determining strippability of the image-receiving layer. Preferably the polymeric resin in the image-receiving layer is impermeable to the solvent used for the heat-developable photosensitive emulsion and is incompatible with the binder polymer used for the emulsion. The combination of such polymers and solvents results in poor adhesion to each other and provides good strippability.

The dyeable image-receiving layer of the invention is any flexible or rigid, transparent (optically clear) thermoplastic resin-containing layer, having a thickness of at least 0.1 micrometer, preferably in the range of 1 to 10 micrometers, and a glass transition temperature in the range of 20° to 200° C. In the present invention any thermoplastic resin or combination of resins can be used provided it is capable of absorbing and fixing the dye. The resin acts as a dye mordant. No additional fixing agents are required. Preferred polymeric thermoplastic resins that can be used in the image-receiving layer include polyesters such as polyethylene and polyethylene terephthalates, cellulosics such as cellulose acetate, cellulose butyrate, cellulose propionate, polystyrene, polyvinylchloride, polyvinylacetate, copolymer of vinylchloride-vinylacetate, copolymer of vinylidene chloride-acrylonitrile, and copolymer of styrene-acrylonitrile.

The dyeable image-receiving element can consist of at least one of the above-mentioned thermoplastic resins, or the image-receiving layer can comprise the thermoplastic resin dissolved in an organic solvent (e.g., methyl ethyl ketone, acetone, tetrahydrofuran) and applied to the support base or substrate by various coating methods known in the art, such as curtain coating, extrusion coating, dip coating, air-knife coating, hopper coating and any other coating method used for solution coating. After coating the image-receiving element is dried (e.g., in an oven) to drive off the solvent.

Preferably, the image-receiving layer is coated adjacent to the heat-developable photosensitive layer. This facilitates diffusion-transfer of the fluoran dye which remains after the image-wise developable, photosensitive layer is subjected to thermal treatment, for example, in a heated shoe and roller type heat processor, as is used in the art. In another embodiment, the colored dye in the heat-developable photosensitive layer can be thermally transferred into a separately coated image-receiving sheet by placing the exposed heat-developable photosensitive layer in intimate face-to-face contact with the image-receiving sheet and heating the resulting composite construction. Good results are achieved in this second embodiment when uniform contact for a time period in the range of 0.5 to 300 seconds between the layers exists during the thermal treatment (in the range of 80° to 220° C.).

Advantages of the heat-developable photographic material provided by this invention include preparation of pure, clear, and stable negative dye images at high photographic speed, as well as low silver requirement.

Objects and advantages of this invention are further illustrated by the following examples, but the particular materials and amounts thereof recited in these examples, as well as other conditions and details, should not be construed to unduly limit this invention. All percents are by weight unless otherwise indicated.

EXAMPLES

A dry silver formulation was prepared consisting of 165 g of half-soap silver behenate (10% solids) in ethanol. An additional 325 g of ethanol was added and the soap was halidized using 6 ml. of a 0.1 mole zinc bromide solution in methanol. To this was added 26 g of Butvar B-72, a polyvinyl butyral, available from Monsanto Chemical Co. and Fluorad TM FC431, a fluorochemical surfactant, available from 3M Company. The thus created dispersion was used in Examples 1–4 below.

The following table indicates the structure of the various dyes utilized in the examples, which are all commercially available from Hodogaya Company. The $R^1$, $R^2$, $R^3$, and $R^4$ substituents refer back to the general formula disclosed earlier herein for the fluoran dyes used in the present invention.

| Dye | $R_1$ | $R_2$ | $R_3$ | $R_4$ |
|---|---|---|---|---|
| LCF003 | N-butyl | N-butyl | H | 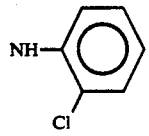 |
| LCF007 | $CH_3$ | 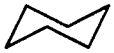 | $CH_3$ | 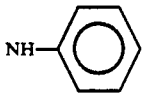 |
| LCF022 | N-butyl | N-butyl | $CH_3$ | 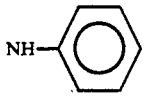 |
| LCF026 | N-butyl | N-butyl | $OCH_3$ | 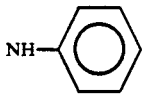 |

EXAMPLE 1

A first coating of 15% VYNS, (Union Carbide) in 50/50 Methylethyl Ketone/Toluene was coated on a polyester substrate at 3 mils wet and dried 3 Min. at 180° F.

A second coating using 20 g of the above silver soap dispersion was finished by adding 0.3 g of LCF003 (Hodogaya) fluoran dye, 0.13 g of 1,2,3-benzotriazin-4(3H)-one, 0.2 g of phthalazinone, and merocyanine sensitizing dye. This was coated 4 mils wet over the first coating and dried 3 min. at 180° F.

A third coating consisting of 20% Cellulose Acetate Propionate (Eastman Chemical) in methanol was coated a 3 mils wet and dried 3 min. at 180° F.

The sample was then exposed on an EG&G sensitometer and developed on a heat blanket producing a dense black image. MacBeth densitometer readings showed a Dmax 1.5, Dmin. 0.20.

Upon stripping the two top layers, a black dye image was observe din the VYNS reception layer. The densities measured on a MacBeth densitometer were Dmax 1.45, Dmin 0.15.

EXAMPLE 2

The same formulations and procedures as Example 1 were used except that 0.3 g of LCF007 (Hodogaya) was used. Exposure and development again produced a good black image in the silver layer and again in the receptor layer. MacBeth density readings were Dmax 1.35 and 0.31 Dmin on the silver image. Transfer densities were Dmax 1.0 and Dmin 0.20.

EXAMPLE 3

The same formulations and procedures as Example 1 were used except that 0.3 g of LCF022 (Hodogaya) was used. A black image was again observed. Silver plus dye densities were Dmax 1.41 and Dmin 0.18. Transfer densities were Dmax 0.90 and Dmin 0.21.

EXAMPLE 4

The same formulations and procedures as Example 1 were used except that 0.3 g of LCF026 (Hodogaya) was used. A blue image was observed in the silver layer and the receptor layer. Silver plus dye densities were Dmax 1.35 and Dmin 0.23. Transfer densities were Dmax 0.66 and Dmin 0.18.

Reasonable modifications and variations are possible from the foregoing disclosure without departing from either the spirit or scope of the present invention as defined by the claims.

I claim:

1. A heat-developable photographic material containing a negative-forming image comprising: (a) a light insensitive silver source material; (b) a light sensitive silver halide; (c) a fluoran dye of the formula:

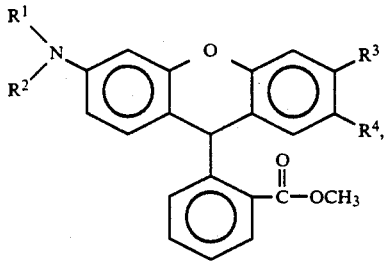

wherein:

$R^1$ represents methyl or n-butyl;

$R^2$ represents n-butyl or cyclohexyl;

$R^3$ represents hydrogen, methyl, or methoxy; and $R^4$ represents

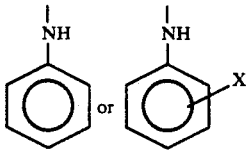

where X represents halogen; and (d) a binder.

2. A heat-developable photographic material according to claim 1 wherein said light insensitive silver source material is a silver salt of an organic acid.

3. A heat-developable photographic material according to claim 2 wherein said light insensitive silver source material is present in said image forming system in an amount of from 20–70 weight percent.

4. A heat-developable photographic material according to claim 1 wherein said light sensitive silver halide is present in an amount of from about 0.75–15 weight percent.

5. A heat-developable photographic material according to claim 1 wherein X is chlorine.

6. A photothermographic composite structure comprising:

(a) an image-receiving element comprising a polymeric image-receiving layer having a glass transition temperature it the range of 20° to 200° C.; and (b) strippably adhered to the image-receiving element an imageable photographic element comprising in at least one layer thereof, a binder, a light-insensitive silver source material, photosensitive silver halide in catalytic proximity to the silver source material, and a fluoran dye of the general formula:

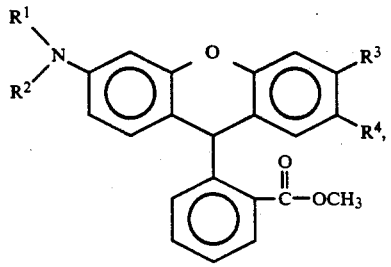

wherein:

$R^1$ represents methyl or n-butyl;

$R^2$ represents n-butyl or cyclohexyl;

$R^3$ represents hydrogen, methyl, or methoxy; and $R^4$ represents

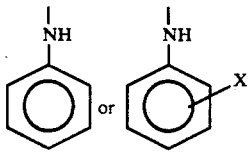

where X represents halogen.

7. The composite structure according to claim 6 wherein said light-insensitive silver source material is a silver salt of an organic acid.

8. The composite structure according to claim 6 wherein X is chlorine.

9. The composite structure according to claim 6, wherein said photothermographic element further comprises a support.

10. The composite structure according to claim 6 wherein said image-receiving element further comprises a support.

11. The composite structure according to claim 9 wherein said support is paper, thermoplastic polymer, glass, or metal.

12. The composite structure according to claim 10 wherein said support is paper, thermoplastic polymer, glass, or metal.

13. The composite structure according to claim 6 wherein said image-receiving layer comprises a polymeric thermoplastic resin selected from the group consisting of polyesters, cellulosics, and polyolefins.

14. The composite structure according to claim 13 where said resin is a polyvinyl or copolymeric vinyl resin.

15. The composite structure according to claim 13 wherein said resin is polyvinyl acetate.

16. The composite structure according to claim 13 wherein said resin is polyvinylchloride.

17. The composite structure according to claim 13 wherein said resin is a copolymer of vinylchloride-vinylacetate.

18. The composite structure according to claim 13 wet said resin is a copolymer of vinylidene chloride-acrylonitrile.

19. The composite structure according to claim 13 wherein said resin is a copolymer of styrene-acrylonitrile.

20. The comprise structure according to claim 6 wherein said photothermographic element further comprises a development modifier.

21. The composite structure according to claim 12 wherein said support is a polymeric thermoplastic resin.

22. The composite structure according to claim 6 wherein said photothermographic element further comprises a stripping agent.

23. The composite structure according to claim 22 wherein said stripping agent is a fluorocarbon compound.

* * * * *